United States Patent [19]

Schulz

[11] Patent Number: 4,981,255

[45] Date of Patent: Jan. 1, 1991

[54] CARRY PACK

[75] Inventor: Günter Schulz, Forchheim, Fed. Rep. of Germany

[73] Assignee: Unilever Patent Holdings, Rotterdam, Netherlands

[21] Appl. No.: 369,601

[22] Filed: Jun. 21, 1989

[30] Foreign Application Priority Data

Jun. 23, 1988 [DE] Fed. Rep. of Germany ..... 3821174

[51] Int. Cl.[5] ..... B65D 5/46

[52] U.S. Cl. ..... 229/117.22; 229/117.23

[58] Field of Search ..... 383/30, 31; 229/117.22, 229/117.23, 132, 3.1

[56] References Cited

U.S. PATENT DOCUMENTS

| | | | |
|---|---|---|---|
| 1,524,399 | 1/1925 | Krueger | 229/117.23 |
| 1,829,533 | 10/1931 | Ondricek | 229/117.23 |
| 2,093,616 | 9/1937 | Mo | 383/30 |
| 2,194,232 | 3/1940 | Peters | 229/117.22 |
| 2,661,892 | 12/1953 | King | 383/30 |
| 3,357,623 | 12/1967 | Wommelsdorf | 229/117.23 |
| 3,383,029 | 5/1968 | Reade | 229/117.23 |
| 3,891,244 | 6/1975 | Ritter et al. | 229/117.23 |
| 4,657,177 | 4/1987 | Karabedian | 229/132 |
| 4,701,360 | 10/1987 | Gibbons et al. | 229/3.1 |

FOREIGN PATENT DOCUMENTS

| | | | |
|---|---|---|---|
| 809693 | 3/1937 | France | 229/117.23 |

*Primary Examiner*—Gary E. Elkins

*Attorney, Agent, or Firm*—Cushman, Darby & Cushman

[57] ABSTRACT

Carry pack made from plastic film that is enclosed on all sides and has a handle for carrying the pack. The handle has two layers, has a folding line at its end facing the top panel of the pack and is sealed to the top panel in the area of this folding line.

2 Claims, 1 Drawing Sheet

CARRY PACK

Figure 1:
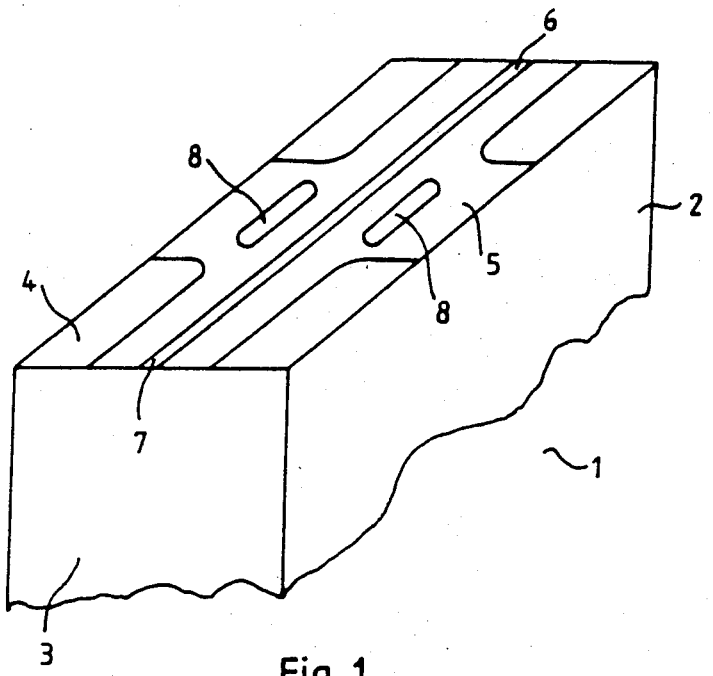

The invention relates to a carry pack made from plastic film that is enclosed on all sides and has a handle for carrying the pack.

In the familiar carry packs of this kind the handle is either an extension of the side panels of the carry pack or is sealed to the same. This either requires a large amount of material or has a not very positive effect on the appearance and display value of the side panels.

The purpose of the invention is to create a carry pack of the kind outlined above that avoids the above-mentioned disadvantages but nevertheless guarantees that the handle functions fully effectively.

In the solution to this problem proposed by the invention, the handle has two layers, has a folding line at its end facing the top panel of the pack and is sealed to the top panel in the area of this folding line.

The handle is therefore only in contact with the top panel of the pack and the side panels are completely free. The sealing nevertheless makes sure that the handle is attached to the carry pack very securely.

It is also very advantageous if in accordance with the invention the seam joining the handle to the carry pack extends at least approximately across the whole length of the top panel.

This ensures that the handle is attached securely enough and that the weight of the contents does not lead to deformation of the carry pack in the area of the top panel.

In a further advantageous development of the invention, the middle section of the handle extends at least approximately across the whole width of the top panel.

The handle is as a result big enough to accommodate a sufficiently large hand hole on each side of the seam.

Figure 2:
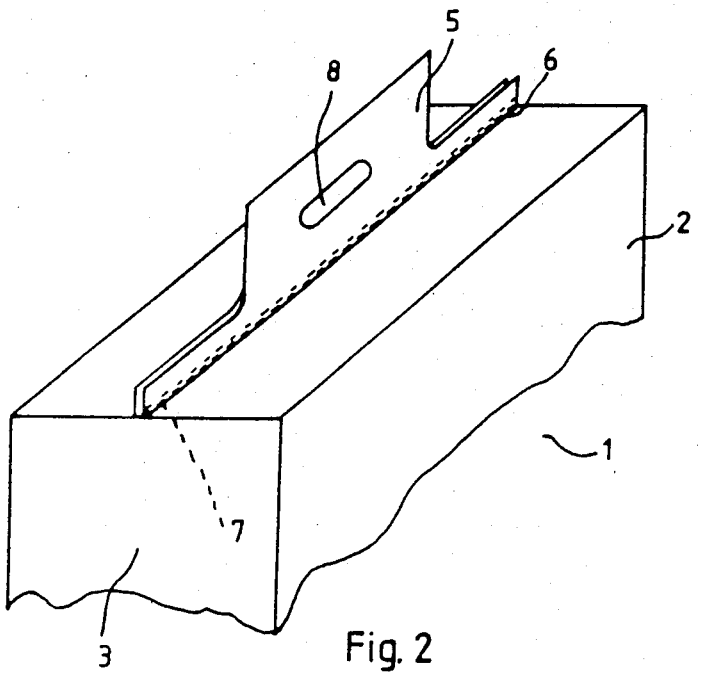

One embodiment of the invention is shown in the drawings:

FIG. 1 shows part of a carry pack with the handle lying flat on top of the top panel of the pack and FIG. 2 also shows part of the carry pack with the handle pointing upwards.

1 in FIG. 1 is a carry pack which has two side panels 2, two end panels 3, a base (not shown) and a top panel 4, which are made from a plastic film and are joined together by folding lines / sealed seams. The carry pack is thus enclosed on all sides and provides very effective protection for the contents. A handle 5, which is located symmetrically to a middle line 6 and is sealed to the top panel 4 along this middle line, rests on the top panel 4. The sealed seam 7 formed in this way extends—like the handle 5—across the whole length of the top panel 4. The handle 5 is provided with two hand holes 8 in its middle section, which extends across the whole width of the top panel 4, so that enough space is available for the hand holes.

In FIG. 2 the handle 5 has been folded upwards into its carrying position, so that it can be taken hold of easily.

I claim:

1. A carry pack made from plastic film and which is enclosed on the bottom, top and side panels and has a handle for carrying the filled pack, wherein the handle lies flat on the top panel (4) of the pack (1) when it is not being used and is connected to the top panel by a sealed seam (7) extending at least approximately across the whole length of the top panel in the middle of the top panel, and wherein the handle (5) has a section provided with a hand hole (8) on each side of the sealed seam that can be folded vertically upwards.

2. The carry pack according to claim 1, wherein the section of the handle is a middle section and extends at least approximately across the whole width of the top panel when it is lying flat on the top panel.

* * * * *